US008725043B2

(12) United States Patent
Hoshio

(10) Patent No.: US 8,725,043 B2
(45) Date of Patent: May 13, 2014

(54) CHARGING MEMBER, CHARGING DEVICE, PROCESS CARTRIDGE, AND IMAGE FORMING APPARATUS

(75) Inventor: Takuro Hoshio, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 13/230,497

(22) Filed: Sep. 12, 2011

(65) Prior Publication Data

US 2012/0213553 A1 Aug. 23, 2012

(30) Foreign Application Priority Data

Feb. 17, 2011 (JP) ..... 2011-032533

(51) Int. Cl.
*G03G 15/02* (2006.01)

(52) U.S. Cl.
USPC ..... 399/176

(58) Field of Classification Search
USPC ..... 399/168, 174, 176
See application file for complete search history.

(56) References Cited

U.S. PATENT DOCUMENTS

| | | | | |
|---|---|---|---|---|
| 7,835,669 | B2 * | 11/2010 | Furukawa et al. | 399/176 |
| 2008/0075505 | A1 * | 3/2008 | Nagamori et al. | 399/176 |

FOREIGN PATENT DOCUMENTS

| | | | |
|---|---|---|---|
| JP | 01-248158 | * | 10/1989 |
| JP | A-06-264918 | | 9/1994 |
| JP | A-07-064378 | | 3/1995 |
| JP | B2-2649162 | | 9/1997 |
| JP | A-2003-316111 | | 11/2003 |
| JP | A-2003-316112 | | 11/2003 |
| JP | A-2006-163059 | | 6/2006 |
| JP | A-2007-101864 | | 4/2007 |
| JP | A-2008-249837 | | 10/2008 |
| JP | A-2008-254991 | | 10/2008 |
| JP | A-2008-273853 | | 11/2008 |
| JP | A-2008-276021 | | 11/2008 |
| JP | A-2008-276022 | | 11/2008 |
| JP | A-2008-276023 | | 11/2008 |
| JP | A-2008-276026 | | 11/2008 |
| JP | 2009-009057 | * | 1/2009 |
| JP | A-2010-102016 | | 5/2010 |
| JP | A-2010-107796 | | 5/2010 |

OTHER PUBLICATIONS

Hisao Sugihara, "Regulation of Morphology of Calcium Carbonate," Journal of the Adhesion Society of Japan, vol. 39, p. 157-162 (2003).

* cited by examiner

*Primary Examiner* — Sandra Brase
(74) *Attorney, Agent, or Firm* — Oliff PLC

(57) ABSTRACT

A charging member includes at least a substrate and a conductive outermost layer that is disposed on the substrate, that comes in contact with a charging object, and that includes (A) a resin and (B) aggregates of a plurality of acicular particles protruding in a radial pattern from a center to an outside. The charging member charges the charging object by coming in contact with the charging object in a state where a voltage is applied to the charging member.

13 Claims, 5 Drawing Sheets

CHARGING MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-032533 filed Feb. 17, 2011.

BACKGROUND (i) Technical Field

The present invention relates to a charging member, a charging device, a process cartridge, and an image forming apparatus.

(ii) Related Art

In an image forming apparatus employing an electrophotographic system, charges are formed on the surface of an image holding member, which includes a photoconducting photoreceptor formed of an inorganic or organic material, by the use of a charging device, an electrostatic latent image is formed thereon by the use of laser light obtained by modulating an image signal, and the electrostatic latent image is developed with charged toner to form a visualized toner image. Then, the toner image is electrostatically transferred to a transferring material such as a recording sheet via an intermediate transfer member or directly and is fixed to the recording material, whereby a desired reproduced image can be obtained.

The charging device performs an important function of charging a charging object such as the image holding member and is roughly classified into a contact type charging device coming in direct contact with the image holding member and charging the image holding member and a non-contact type charging device charging the image holding member in the vicinity of the image holding member without coming into contact with the image holding member by corona discharge or the like. Recently, charging devices employing a contact charging type in which secondary generation of ozone or nitrogen oxide due to the discharge is reduced have increased more and more.

SUMMARY

According to a first aspect of the invention, there is provided a charging member including at least: a substrate; and a conductive outermost layer that is disposed on the substrate, that comes in contact with a charging object, and that includes (A) a resin and (B) aggregates of a plurality of acicular particles protruding in a radial pattern from a center to an outside, wherein the charging member charges the charging object by coming into contact with the charging object in a state where a voltage is applied to the charging member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Charging Member

Figure 1:
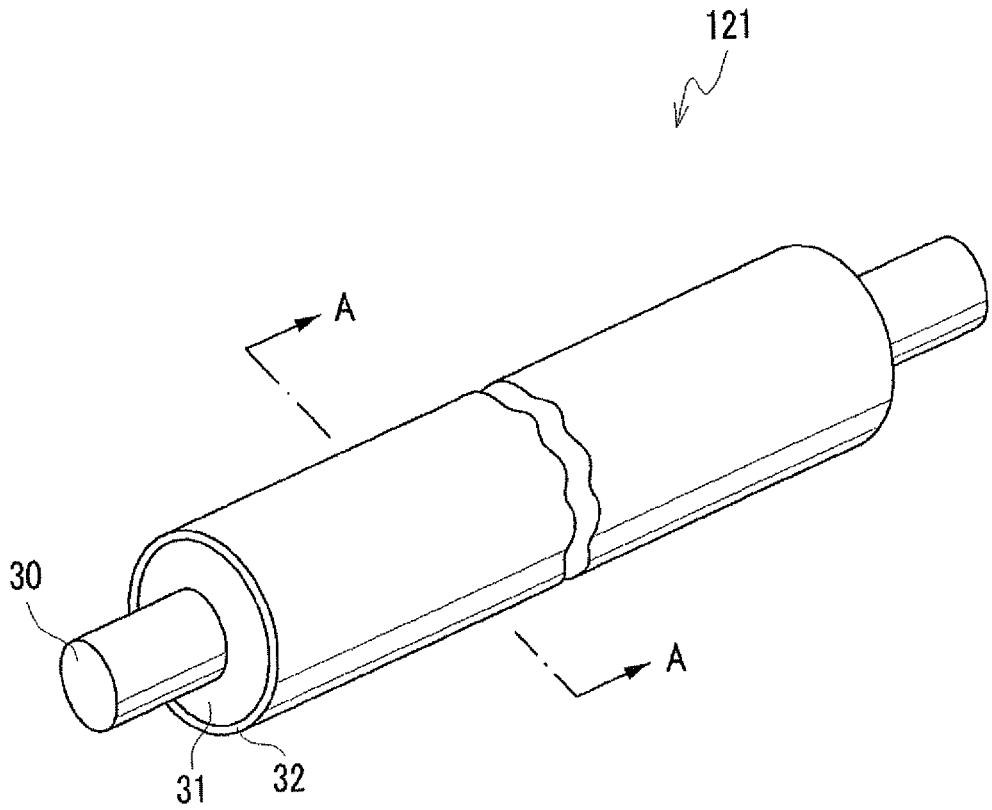
FIG. 1 is a perspective view schematically illustrating a charging member according to an exemplary embodiment of the invention.
Figure 2:
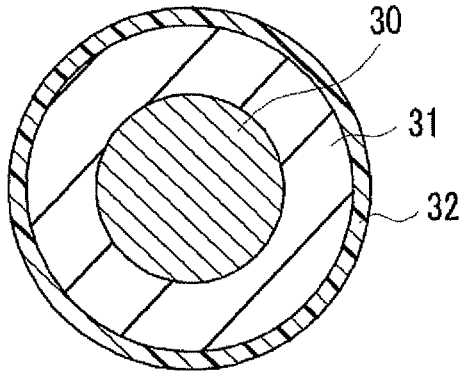
FIG. 2 is a sectional view schematically illustrating the charging member according to the exemplary embodiment.

FIG. 1 is a perspective view schematically illustrating a charging member according to an exemplary embodiment of the invention. FIG. 2 is a sectional view schematically illustrating the charging member according to this exemplary embodiment. FIG. 2 is a sectional view taken along line A-A of FIG. 1.

As shown in FIGS. 1 and 2, the charging member 121 according to this exemplary embodiment is, for example, a roll member including a cylindrical or columnar substrate 30 (shaft), a conductive elastic layer 31 disposed on the outer periphery of the substrate 30, and a conductive outermost layer 32 disposed on the outer periphery of the conductive elastic layer 31.

The conductive outermost layer 32 is, for example, a layer coming into contact with a charging object and includes (A) a resin and (B) aggregates of plural acicular particles protruding in a radial pattern from the center to the outside.

By causing the conductive outermost layer 32 to have the above-mentioned configuration, the charging member 121 according to this exemplary embodiment can charge a charging object with reduced deviation in spite of repeated use thereof.

The reason for this is uncertain but it is considered that the reason is as follows.

Figure 3:
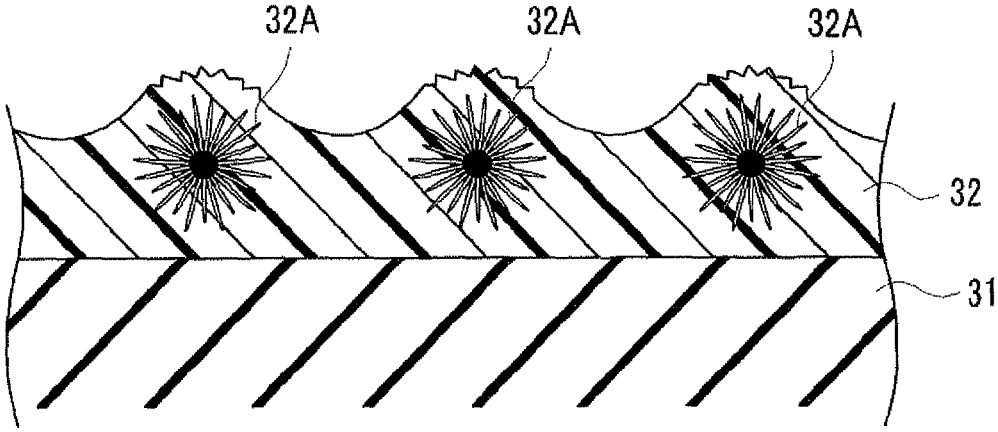
FIG. 3 is an enlarged sectional view schematically illustrating the charging member according to the exemplary embodiment.

When the conductive outermost layer 32 coming into contact with a charging object includes aggregates, it is thought that the surface of the conductive outermost layer 32 in the region where the aggregates are present is convex along the particle diameter of each aggregate and the aggregates are scattered, whereby convex and concave portions with a large pitch are formed (see FIG. 3). Since the generation of filming of external additives of the toner can be suppressed by the convex and concave portions, it is thought that the contamination of the surface of the conductive outermost layer 32 is suppressed and the decrease in charging performance due to the repeated use thereof is suppressed.

On the other hand, since the plural acicular particles in each aggregate protrude in a radial pattern from the center to the outside and are aggregated, it is thought that convex and concave portions with a small pitch are additionally formed on the convex surface of the conductive outermost layer 32, which is formed by the aggregate, due to the tips of the plural acicular particles (see FIG. 3). Since the number of discharge positions on the surface of the conductive outermost layer 32 increases due to the convex and concave portions, it is thought that the charging deviation on a charging object is suppressed.

Accordingly, in the charging member 121 according to this exemplary embodiment, it is thought that it is possible to charge a charging member with reduced deviation in spite of the repeated use thereof.

FIG. 3 is an enlarged sectional view schematically illustrating the charging member according to this exemplary embodiment. In FIG. 3, reference numeral 32A represents the aggregates.

Here, in this exemplary embodiment, it is assumed that the charging member 121 has the form of a roll member. However, the shape of the charging member 121 is not particularly limited, and examples thereof include various shapes such as a roll shape, a brush shape, a belt (tube) shape, and a blade shape. Among these shapes, the roll-shaped member described in this exemplary embodiment is preferable. That is, it is preferable that the charging member have a so-called charging roll shape.

The charging member 121 according to this exemplary embodiment is not limited to the above-mentioned configuration, but may have a configuration not including the conductive elastic layer 31 or a configuration including an intermediate layer disposed between the conductive elastic layer 31 and the substrate 30, a resistance adjusting layer or a transition preventing layer disposed between the conductive elastic layer 31 and the conductive outermost layer 32, and a coating layer (protective layer) disposed on the outer surface (the outermost surface) of the conductive outermost layer 32. The charging member 121 according to this exemplary embodiment may include only the substrate 30 and the conductive outermost layer 32.

The constituent elements of the charging member 121 according to this exemplary embodiment will be described in detail below.

The conductivity in this specification means that the volume resistivity at 20° C. is less than 1×10 Ωcm. The semi-conductivity in this specification means that the volume resistivity at 20° C. is in the range of from 1×10 Ωcm to $1\times10^{10}$ Ωcm.

(Substrate)

The substrate 30 will be first described.

The substrate 30 is formed of metal or alloy such as aluminum, copper alloy, and stainless steel, iron plated with chromium, nickel, and the like, and a conductive material such as a conductive resin.

The substrate 30 serves as an electrode and a support of the charging roll and examples of the material thereof include metal such as iron (such as free-cutting steel), copper, brass, stainless steel, aluminum, and nickel. In this exemplary embodiment, the substrate 30 is a conductive rod-like member and examples of the substrate 30 include a member (for example, a resin or ceramic member) of which the outer surface is plated and a member (for example, a resin or ceramic member) in which a conductive agent is dispersed. The substrate 30 may be a hollow member (cylindrical member) or a non-hollow member.

Conductive Elastic Layer

The conductive elastic layer 31 will be described below.

The conductive elastic layer 31 includes, for example, an elastic material, a conductive agent, and other additives if necessary. The conductive elastic layer 31 is a layer directly formed on the outer peripheral surface of the substrate 30 as needed.

Examples of the elastic material include isoprene rubber, chloroprene rubber, epichlorohydrin rubber, butyl rubber, polyurethane, silicone rubber, fluorine rubber, styrene-butadiene rubber, butadiene rubber, nitrile rubber, ethylene-propylene rubber, epichlorohydrin-ethyleneoxide copolymer rubber, epichlorohydrin-ethyleneoxide-allylglycidylether copolymer rubber, ethylene-propylene-diene ternary copolymer rubber (EPDM), acrylonitrile-butadiene copolymer rubber (NBR), natural rubber, and blended rubber thereof. Among these, polyurethane, silicone rubber, EPDM, epichlorohydrin-ethyleneoxide copolymer rubber, epichlorohydrin-ethyleneoxide-allylglycidylether copolymer rubber, NBR, and blended rubber thereof can be preferably used. These elastic materials may be foamed or non-foamed.

Examples of the conductive agent include an electron conductive agent and an ion conductive agent. Examples of the electron conductive agent include powders of carbon black such as ketjen black and acetylene black; pyrolytic carbon, graphite; various conductive metals or alloys such as aluminum, copper, nickel, and stainless steel; various conductive metal oxides such as tin oxide, indium oxide, titanium dioxide, tin oxide-antimony oxide solid solution, and tin oxide-indium oxide solid solution; and insulating materials of which the surface is processed into conductivity. Examples of the ion conductive agent include perchlorates and chlorates of tetraethyl ammonium and lauryl trimethyl ammonium; alkali metal such as lithium and magnesium, and perchlorates and chlorates of alkali earth metal.

These conductive agents may be used singly or in a combination of two or more.

Here, specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V" of which all are made by Evonik Industries AG and "MONARCH 1000", "MONARCH 1300", "MONARCH 1400", "MOGUL-L", and "REGAL 400R" of which all are made by Cabot Corporation.

The average particle diameter of these conductive agents is preferably in the range of from 1 nm to 200 nm.

The average particle diameter is calculated by observing a sample obtained by cutting the conductive elastic layer 31 with an electron microscope, measuring the diameters (the maximum diameters) of 100 conductive agent particles, and averages the measured diameters.

The average particle diameter may be measured, for example, by the use of Zetasizer Nano ZS made by Sysmex Corporation.

The amount of conductive agent to be added is not particularly limited. However, in the case of the electron conductive agent, the amount of conductive agent is preferably in the range of from 1 part by weight to 30 parts by weight with respect to 100 parts by weight of the elastic material and more preferably in the range of from 15 parts by weight to 25 parts by weight. In the case of the ion conductive agent, the amount of conductive agent is preferably in the range of from 0.1 part by weight to 5.0 parts by weight with respect to 100 parts by weight of the elastic material and more preferably in the range of from 0.5 part by weight to 3.0 parts by weight.

Examples of the other additives mixed into the conductive elastic layer 31 include materials which can be typically added to an elastic layer, such as a softener, a plasticizer, a curing agent, a vulcanizing agent, a vulcanization accelerator, an antioxidant, a surfactant, a coupling agent, and a filler (such as silica and calcium carbonate).

At the time of forming the conductive elastic layer 31, the mixing method or the mixing order of the components such as the conductive agent, the elastic material, and the other components (the vulcanizing agent or a foaming agent to be added as needed) is not particularly limited. In general, all the components are mixed in advance by a tumbler drier or a V blender and are melted and mixed by the use of an extruder to extrude and mold the resultant.

The thickness of the conductive elastic layer 31 is preferably in the range of from 1 mm to 10 mm and more preferably in the range of from 2 mm to 5 mm.

The volume resistivity of the conductive elastic layer 31 is preferably in the range of from $10^3$ Ωcm to $10^{14}$ Ωcm.

Conductive Outermost Layer

The conductive outermost layer 32 will be described below.

The conductive outermost layer 32 is a conductive outermost layer coming in contact with, for example, a charging object, includes (A) a resin and (B) aggregates of plural acicular particles protruding in a radial pattern from the center to the outside, and further includes other additives such as a conductive agent as needed.

(A) Resin

A resin that can form a resin coating constituting the outermost layer is selected as the resin.

Examples of the resin constituting the outermost layer include a polyamide resin, a polyvinyl acetal resin, an acrylic resin, a polyester resin, a phenol resin, an epoxy resin, a melamine resin, and a benzoguanamine resin.

Another preferable example thereof is a copolymerized nylon (Amiran CM-8000, made by Toray Industries Inc.) which includes one or more species of 610 nylon, 11 nylon, and 12 nylon as a polymerization unit. Examples of another polymerization unit included in the copolymer include 6 nylon and 66 nylon. The elastic material mixed into the conductive elastic layer 31 may be used as the resin.

Only one species thereof may be used or two or more species thereof may be used. However, in terms of an effect, it is preferable that a polyamide resin be included as the main component of the resin.

Since the polyamide resin is excellent in attachment to the toner and the external additives and makes it difficult to frictionally charge a charging object to plus by contact, the attachment of the toner or the external additives to the charging member is suppressed.

The polyamide resin used as the resin is not particularly limited, but examples thereof include polyamide resins described in "Handbook of Polyamide Resin", written by Osamu Fukumoto, 8400, published by Nikkan Kogyo Shimbun Ltd. and alcohol-soluble polyamide among the examples can be preferably used.

Preferable examples of the alcohol-soluble polyamide include N-alkoxy-methylated polyamide and N-methoxy-methylated polyamide (N-methoxy-methylated nylon, TORESIN made by Nagase ChemteX Corporation).

Examples of the polyvinyl acetal resin used as the resin include a polyvinyl butyral resin, a polyvinyl formal resin, a partially-acetal-modified polyvinyl butyral resin in which a part of butyral is modified into formal or acetoacetal.

A polyester resin including an acid-derived component and an alcohol-derived component is used as the polyester resin used as the resin and may contain other components as needed.

The polyester resin is synthesized from an acid (dicarboxylic acid) component and an alcohol (diol) component. In this specification, the "acid-derived component" means an acidic part before the synthesis of the polyester resin and the "alcohol-derived component" means an alcoholic part before the synthesis of the polyester resin.

That is, the polyester resin used as the resin is synthesized by an ordinary method, for example, using the acid-derived component and the alcohol-derived component.

The components used to synthesize the polyester resin will be described below.

As the acid-derived component, an aliphatic dicarboxylic acid is preferable and a straight-chain carboxylic acid is more preferable. Examples thereof include an oxalic acid, a malonic acid, a succinic acid, a glutaric acid, an adipic acid, a pimelic acid, a suberic acid, an azelaic acid, a sebacic acid, a 1,9-nonane dicarboxylic acid, a 1,10-decane dicarboxylic acid, a 1,11-undecane dicarboxylic acid, 1,12-dodecane dicarboxylic acid, a 1,13-tridecane dicarboxylic acid, a 1,14-tetradecane dicarboxylic acid, a 1,16-hexadecane dicarboxylic acid, a 1,18-octadecane dicarboxylic acid, and lower alkylesters or acid anhydrides thereof, but the acid-derived component is not limited to these examples.

In addition to the aliphatic dicarboxylic acid-derived component, components such as a dicarboxylic acid-derived component having a double bond and a dicarboxylic acid-derived component having a sulfonate group are preferably included as the acid-derived component.

The dicarboxylic acid-derived component having a double bond includes components derived from lower alkyl esters or acid anhydrides of a dicarboxylic acid having a double bond, in addition to the component derived from the dicarboxylic acid having a double bond. The dicarboxylic acid-derived component having a sulfonate group includes components derived from lower alkyl esters or acid anhydrides of a dicarboxylic acid having a sulfonate group, in addition to the component derived from the dicarboxylic acid having a sulfonate group.

For example, the dicarboxylic acid having a double bond is preferably a dicarboxylic acid and examples thereof include a fumaric acid, a maleic acid, a 3-hexenedioic acid, and a 3-octenedioic acid, to which the dicarboxylic acid having a double bond is not limited. Examples thereof further include lower alkyl esters or acid anhydrides thereof. Among these, the fumaric acid and the maleic acid can be preferably used in terms of cost.

Examples of the alcohol-derived component include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol, but the alcohol-derived component is not limited to these examples.

Here, examples of the other components used as needed in addition to the acid-derived component and the alcohol-derived component include a diol-derived component having a double bond and a diol-derived component having a sulfonate group.

Examples of the diol having a double bond include 2-butene-1,4-diol, 3-butene-1,6-diol, and 4-butene-1,8-diol.

Examples of the dial having a sulfonate group include 1,4-dihydroxy-2-benzene sodium sulfonate, 1,3-dihydroxymethyl-5-benzene sodium sulfonate, and 2-sulfo-1,4-butanediol sodium salt.

Examples of the phenol resin used as the resin preferably include phenols such as resorcin and bisphenol, substituted phenols having a hydroxy group such as cresol, xylenol, paraalkyl phenol, and paraphenyl phenol, substituted phenols having two hydroxy groups such as catechol, resorcinol, and hydroquinone, bisphenols such as bisphenol A and bisphenol Z, biphenols, monomers of monomethylol phenols, dimethylol phenols, trimethylol phenols obtained by causing a compound having a phenol structure to react with formaldehyde, paraformaldehyde, or the like in the presence of an acidic or alkali catalyst, mixtures thereof, oligomers thereof, and mixtures of monomer and oligomer.

The epoxy resin used as the resin means all of monomers, oligomers, and polymers having two or more epoxy groups in a molecule. The molecular weight and the molecular structure thereof are not particularly limited, and examples thereof include a biphenyl-type epoxy resin, a bisphenol-type epoxy resin, a stilbene-type epoxy resin, a phenol novolac-type epoxy resin, a cresol novolac-type epoxy resin, a triphenol methane-type epoxy resin, an alkyl-modified triphenol methane-type epoxy resin, a triazine nucleus-containing epoxy resin, a dicyclopentadiene-modified phenol-type epoxy resin, a phenol aralkyl-type epoxy resin (having a phenylene skeleton, a diphenylene skeleton, and the like). These may be used singly or in a combination thereof.

Among these, the biphenyl-type epoxy resin, the bisphenol-type epoxy resin, the stilbene-type epoxy resin, the phenol novolac-type epoxy resin, the cresol novolac-type epoxy resin, and the triphenol methane-type epoxy resin can be preferably used, the biphenyl-type epoxy resin, the bisphenol-type epoxy resin, the phenol novolac-type epoxy resin, and the cresol novolac-type epoxy resin can be more preferably used, and the bisphenol-type epoxy resin can be yet more preferably used.

Known compounds having a guanamine structure or a melamine structure can be used as the melamine resin and the benzoguanamine resin used as the resin and examples thereof include compounds expressed by Formulas (A) and (B). The compounds expressed by Formulas (A) and (B) are synthesized by known methods (for example, see "Lecture of Experimental Chemistry", 4-th edition, Vol. 28, p. 430) using guanamine or melamine and formaldehyde. These may be used singly or in a combination, but the combination or the use as oligomer improves the solubility, which is more preferable.

(A)

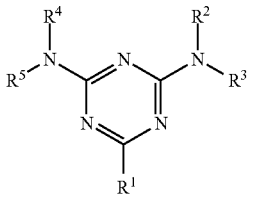

In Formula (A), $R^1$ represents a straight-chain or branched alkyl group having a carbon number of 1 to 10, a substituted or unsubstituted phenyl group having a carbon number of 6 to 10, or a substituted or unsubstituted alicyclic hydrocarbon group having a carbon number of 4 to 10. $R^2$ to $R^5$ independently represent a hydrogen atom, —$CH_2$—OH, or —$CH_2$—O—$R^6$. $R^6$ represents a straight-chain or branched alkyl group having a carbon number of 1 to 10.

(B)

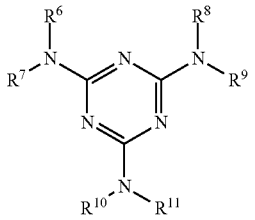

In Formula (B), $R^6$ to $R^{11}$ independently represent a hydrogen atom, —$CH_2$—OH, —$CH_2$ —O—$R^{12}$, or —O—$R^{12}$. $R^{12}$ represents an optionally branched alkyl group having a carbon number of 1 to 5. Examples of the alkyl group include a methyl group, an ethyl group, and a butyl group.

The compounds expressed by Formula (B) are synthesized by a known method (for example, in the same manner as for the melamine resin described in "Lecture of Experimental Chemistry", 4-th edition, Vol. 28, p. 430), for example, using melamine and formaldehyde.

The guanamine resin and the melamine resin are commercially available and examples thereof include Super Beckamine (R) L-148-55, Super Beckamine (R) 13-535, Super Beckamine (R) L-145-60, and Super Beckamine (R) TD-126 (all of which are made by DIC Co., Ltd.), Nikalac BL-60 and Nikalac BX-4000 (both of which are made by Nippon Carbide Industries Co., Ltd.) (hitherto, guanamine resins), Super Melami No. 90 (made by NOF Corporation), Super Beckamine (R) TD-139-60 (made by DIC Co., Ltd.), Yuban 2020 (made by Mitsui Chemicals Inc.), Sumitex Resin M-3 (made by Sumitomo Chemical Co., Ltd.), and Nikalac MW-30 (made by Nippon Carbide Industries Co., Ltd.). These commercial products may be used without any change.

(B) Aggregates

An aggregate is a set of particles formed by causing plural acicular particles to protrude and aggregate in a radial pattern from the center to the outside (see FIG. 3).

Specifically, the aggregate is a set of particles in which ends of plural acicular particles are collected (united) and the other ends of the plural acicular particles extend in a radial pattern in different directions with the collected parts as a center (see FIG. 3).

The acicular particles constituting the aggregate may be particles having a linear shape of which both ends are sharp or particles having a linear shape of which both ends have an end surface.

The acicular particles of the aggregate may be, for example, inorganic particles (for example, calcium carbonate particles and zinc oxide particles) and the calcium carbonate particles are preferable in terms of easy design of the shape or particle diameter of the aggregate.

The length of the acicular or columnar particles of the aggregate is, for example, in the range of from 0.5 μm to 20 μm (preferably in the range of from 1 μm to 10 μm) and the outer diameter thereof is, for example, in the range of from 0.01 μm to 5 μm (preferably in the range of from 0.5 μm to 3 μm).

The aggregates are produced, for example, as follows.

When the calcium carbonate particles are used as the acicular particles, the aggregates are produced by repeating a process of stopping the carbonation at a carbonation rate of 10% to 90% and restarting the carbonation with an addition of a new lime milk by two to fifteen times at the time of introducing carbonate gas into a lime milk to synthesize calcium carbonate by the use of simplicity of a lime milk method and then finishing the carbonation reaction at a reaction temperature of 50° C. or higher.

When the zinc oxide particles are used as the acicular particles, for example, the aggregates are produced by mixing a zinc compound solution and an amine compound, precipitating deposits at a pH of the aqueous solution of 7 or more, and then heating the aqueous solution at 40° C. or higher.

The shape and particle diameter of the aggregates can be preferably set as follows.

The average circularity of the aggregates is preferably in the range of from 0.8 to 1.0 (or from about 0.8 to about 1.0).

The average circularity is calculated using the following expression based on measurement of the circularity using a sample cut from the conductive outermost layer 32 and using a flow particle image analyzer FPIA-3000 made by Sysmex Corporation.

Expression:

$$\text{Circularity}=\text{circumference of circle having the same area as particle-projected area/circumference of particles}=(2\times(A\pi)^{1/2})/PM$$

(wherein A represents a projected area and PM represents a circumference).

The circularities of 5000 particles are averaged to acquire an average circularity.

The circularity of an aggregate is measured and calculated on the basis of a shape formed by a virtual surface (virtual curved surface) connecting the tips of the acicular particles protruding in a radial pattern.

Here, as indicated by the average circularity, the aggregate preferably has a circular shape or a shape similar thereto. When the aggregate has a particle shape satisfying the average circularity, the unevenness in thickness of the conductive outermost layer 32 in a region where the aggregate is present is suppressed, compared with an infinite particle shape having a corner, thereby charging a charging object with reduced deviation.

The average particle diameter of the aggregates is preferably in the range of from 3 μm to 20 μm (or from about 3 μm to about 20 μm), more preferably in the range of from 3 μm to 15 μm (or from about 3 μm to about 15 μm), and yet more preferably in the range of from 3 μm to 12 μm (or from about 3 μm to about 12 μm).

The average particle diameter is calculated by observing a sample cut out from the conductive outermost layer 32 by the use of an electron microscope, measuring the diameters (the maximum diameters) of 100 aggregates, and averaging the measured diameters.

The average particle diameter may be measured, for example, by the use of Zetasizer Nano ZS made by Sysmex Corporation.

The average particle diameter of the aggregates is measured and calculated on the basis of a shape formed by a virtual surface (virtual curved surface) connecting the tips of the acicular particles protruding in a radial pattern.

By employing the aggregates satisfying the average shape factor and the average particle diameter, it is possible to achieve the surface roughness of the conductive outermost layer and the generation of contamination of the resultant charging member due to the attachment of the toner or the external additives is suppressed, thereby charging a charging object with reduced deviation in spite of the repeated use thereof.

(C) Other Additives

An example of the other additive is a conductive agent. Examples of this conductive agent include the conductive agents mixed into the conductive elastic layer 31.

Examples of the other additives include materials which can be typically added to a surface layer, such as a softener, a plasticizer, a curing agent, a vulcanizing agent, a vulcanization accelerator, an antioxidant, a surfactant, and a coupling agent.

Contents

Regarding the contents of the components of the conductive outermost layer 32, the content of (A) the resin is in the range of from 20 weight % to 99 weight % and preferably in the range of from 10 weight % to 95 weight %, the content of (B) the aggregates is in the range of from 1 weight % to 50 weight % (or from about 1 weight % to about 50 weight %) and preferably in the range of from 3 weight % to 45 weight % (or from about 3 weight % to about 45 weight %), and the content of (C) the conductive agent, which is added as needed, is in the range of from 1 weight % to 50 weight % and preferably in the range of from 1 weight % to 30 weight %.

In terms of suppression of the deviation in thickness of the conductive outermost layer 32 or in dispersion state of (B) the aggregates, it is preferable that the solid content concentration in the application solution used to form the conductive outermost layer be in the range of from 5 weight % to 50 weight %.

Method of Forming Conductive Outermost Layer

The conductive outermost layer 32 is formed by applying an application solution in which the above-mentioned components are dissolved or dispersed in a solvent to the substrate 30 (the outer peripheral surface of the conductive elastic layer 31) by the use of a dipping method, a spray method, a vacuum deposition method, a plasma coating method, or the like and drying the formed film.

The drying conditions are determined depending on the types and amounts of the resin or catalyst used, but the drying temperature is preferably in the range of from 40° C. to 200° C. and more preferably in the range of from 50° C. to 180° C.

The drying time is preferably in the range of from 5 minutes to 5 hours and more preferably in the range of from 10 minutes to 3 hours.

An example of the drying method is a hot-air drying.

Here, a catalyst may be used for the conductive outermost layer 32 (the application solution forming the conductive outermost layer) so as to promote the curing of the resin. An acid-based catalyst is preferably used as a curing catalyst.

Examples of the acid-based catalyst include aliphatic carboxylic acids such as an acetic acid, a chloroacetic acid, a trichloroacetic acid, a trifluoroacetic acid, an oxalic acid, a maleic acid, a malonic acid, and a lactic acid, aromatic carboxylic acids such as a benzoic acid, a phthalic acid, a terephthalic acid, and a trimellitic acid, aliphatic and aromatic sulfonic acids such as a methanesulfonic acid, a dodecylsulfonic acid, a benzenesulfonic acid, a dodecylbenzenesulfonic acid, and a naphthalenesulfonic acid and the sulfur-containing materials can be preferably used.

In the conductive outermost layer 32, a catalyst is added thereto to form a high-density cross-linking structure, whereby the strength and the durability are improved. A gel percentage can be used as a criterion for detecting desirable properties of the conductive outermost layer. That is, the gel percentage of the formed conductive outermost layer is preferably equal to or greater than 50%.

The gel percentage is measured on the basis of the JIS K6796.

Specifically, an application solution obtained by dissolving the components of the conductive outermost layer in a solvent is applied to an aluminum plate with a bar coater to form a film with a thickness of 100 μm. The formed film is dried and then is heated and cured at the curing temperature and in the curing time corresponding to the types of the resin and the catalyst. The resultant is cooled to the room temperature (25°), the weight of the formed layer is measured, and the measured weight is set as the weight of the material before extracting the solvent.

This layer is immersed in the solvent used to produce the application solution for 24 hours, the solvent is filtrated, the residual is filtrated, and then the weight is measured. The measured weight is set as the weight of the material after extracting the solvent.

The degree of cross-linkage is calculated using the following expression.

Expression

Gel Percentage=100×(weight after extraction)/(weight before extraction)

When the calculated degree of cross-linkage is equal to or greater than 50%, it is determined that the cross-linking density of the resin in the conductive outermost layer 32 is improved and the layer has excellent crack resistance.

The measuring sample may be obtained by cutting a part of the conductive outermost layer 32 from the charging member and may be measured.

Characteristics of Conductive Outermost Layer

The ten-point average surface roughness Rz of the surface of the conductive outermost layer 32 (that is, the surface of the charging member 121) is, for example, in the range of from 2 μm to 20 μm, preferably in the range of from 3 μm to 12 μm, more preferably in the range of from 7 μm to 12 μm, and yet more preferably in the range of from 10 μm to 12 μm.

By setting the ten-point average surface roughness to this range, it is possible to give a charging property with reduced deviation and, as a secondary effect, it is difficult to attach particles of the toner or the external additives to the conductive outermost layer 32, thereby improving the contamination resistance.

When the ten-point average surface roughness Rz is less than 2 μm, particles of the toner or the external additives may be attached to the surface. When the ten-point average surface roughness Rz is greater than 20 μm, the toner and the paper powder easily stay in the convex and concave portions, local abnormal discharge can be easily caused, and an image defect such as white missing may be caused.

The ten-point average surface roughness Rz of the surface of the conductive outermost layer 32 is embodied by mixing (B) the aggregates.

Here, the ten-point average surface roughness Rz is surface roughness defined in the JIS B0601 (1994). The ten-point average surface roughness Rz is measured by the use of surface roughness measuring instrument or the like and is specifically measured under the conditions of 23° C. and 55 RH % by the use of a contact-type surface roughness measuring instrument (SURFCOM 570A, made by Tokyo Seimitsu Co., Ltd.). At the time of measuring the surface roughness, the measuring distance is set to 2.5 mm, a stylus of which the tip is formed of diamond (5 μmR, 90° cone) is used as a contact stylus, and the average value of the results repeatedly measured three times at different positions is calculated as the ten-point average surface roughness Rz.

The thickness of the conductive outermost layer 32 is preferably thick in consideration of the durability due to the abrasion of the charging member 121. However, when the thickness of the conductive outermost layer is excessively large, the charging performance for a charging object tends to decrease. Accordingly, the thickness is in the range of from 0.01 μm to 1000 μm and preferably in the range of from 3 μm to 25 μm.

The volume resistivity of the conductive outermost layer 32 is preferably in the range of from $10^3$ Ωm to $10^{14}$ Ωcm.

The charging member 121 according to this exemplary embodiment is manufactured by sequentially forming the conductive elastic layer 31 and the conductive outermost layer 32 on the outer peripheral surface of the substrate 30, for example, by the use of a blade coating method, a Mayer bar coating method, a spray coating method, a dipping coating method, a bead coating method, an air-knife coating method, or a curtain coating method.

Charging Device

A charging device according to this exemplary embodiment will be described below.

Figure 4:
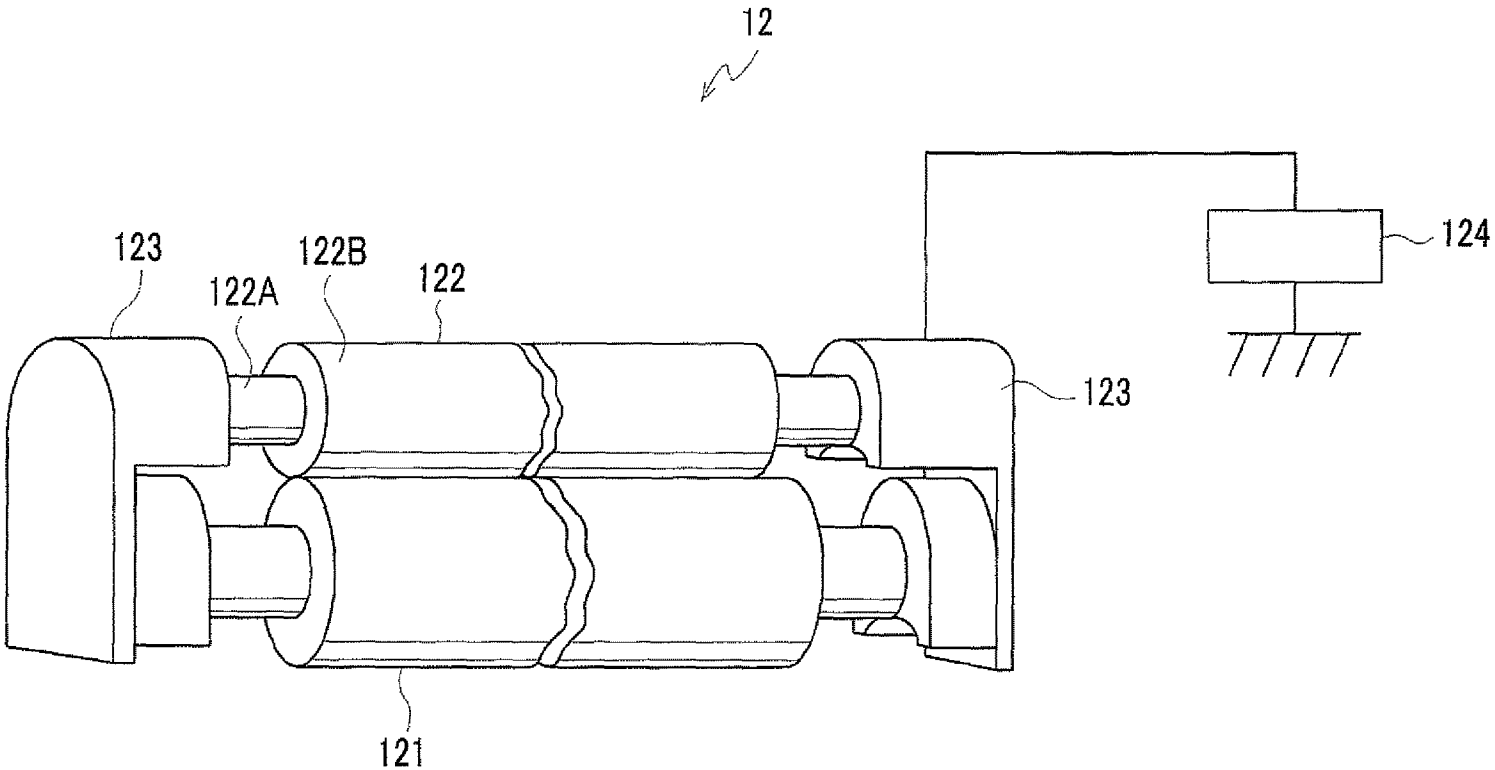
FIG. 4 is a perspective view schematically illustrating a charging device according to the exemplary embodiment.

FIG. 4 is a perspective view schematically illustrating the charging device according to this exemplary embodiment.

The charging device according to this exemplary embodiment employs the charging member according to this exemplary embodiment as a charging member.

Specifically, in the charging device 12 according to this exemplary embodiment, the charging member 121 and a cleaning member 122 are disposed in contact with each other with a specific amount of inroad as shown in FIG. 4. Both ends in the axis direction of the substrate 30 of the charging member 121 and a substrate 122A of the cleaning member 122 are held by conductive bearings 123 (conductive bearings) so as to allow the members to rotate. One of the conductive bearings 123 is connected to a power source 124.

The charging device according to this exemplary embodiment is not limited to the above-mentioned configuration, and may have a configuration without the cleaning member 122.

The cleaning member 122 is a cleaning mechanism that cleans the surface of the charging member 121 and is formed, for example, in a roll shape. The cleaning member 122 has, for example, a configuration having a cylindrical or columnar substrate 122A and an elastic layer 122B on the outer peripheral surface of the substrate 122A.

The substrate 122A is a conductive rod-like member and examples of the material thereof include metals such as iron (such as free-cutting steel), copper, brass, stainless steel, aluminum, and nickel. Examples of the substrate 122A further include a member (for example, a resin or ceramic member) of which the outer surface is plated and a member (for example, a resin or ceramic member) in which a conductive agent is dispersed. The substrate 122A may be a hollow member (cylindrical member) or a non-hollow member.

The elastic layer 122B is formed of a foam having a porous three-dimensional structure, has voids or unevenness (hereinafter, referred to as cells) in or on the surface thereof, and preferably has elasticity. The elastic layer 122B includes foamed resin materials or rubber materials such as polyurethane, polyethylene, polyamide, olefin, melamine or polypropylene, acrylonitrile-butadiene copolymer rubber (NBR), ethylene-propylene-dien copolymer rubber (EPDM), natural rubber, styrene-butadiene rubber, chloroprene, silicone, and nitrile.

Among the foamed resin materials and rubber materials, polyurethane resistant to tearing and tensile strength can be particularly suitably used so as to efficiently clean particles of the toner or the external additives by the frictional slide over the charging member 121, to make it difficult to damage the surface of the charging member 121 due to the friction with the cleaning member 122, and to make it difficult to disconnect or break the member for a long time.

The polyurethane is not particularly limited, and examples thereof include reactants obtained from polyols (such as polyester polyol, polyether polyol, and acrylpolyol) and isocyanates (such as 2,4-trilene diisocyanate, 2,6-trilene diisocyanate, 4,4-diphenylmethane diisocyanate, tolidine diisocyanate, and 1,6-hexamethylene diisocyanate) and reactants obtained by using chain extenders thereof (such as 1,4-butanediol and trimethylol propane). The polyurethane is typically foamed using a foaming agent (such as water or azo compounds (such as azodicarbonamide and azobisisobutyronitrile).

The number of cells in the elastic layer 122B is preferably in the range of from 20/25 mm to 80/25 mm, more preferably in the range of from 30/25 mm to 80/25 mm, and yet more preferably in the range of from 30/25 mm to 50/25 mm.

The hardness of the elastic layer 122B is preferably in the range of from 100 N to 500 N, more preferably in the range of from 100 N to 400 N, and yet more preferably in the range of from 150 N to 400 N.

The conductive bearings 123 are members holding the charging member 121 and the cleaning member 122 so as to be rotatable together and maintaining the inter-shaft distance therebetween. The conductive bearings 123 may be of any material and in any shape, as long as they are formed of a conductive material. Examples thereof include a conductive bearing or a conductive sliding bearing.

The power source 124 is a device that applies a voltage to the conductive bearings 123 to charge the charging member 121 and the cleaning member 122 to the same polarity and a known high-voltage power source is used.

In the charging device 12 according to this exemplary embodiment, the charging member 121 and the cleaning member 122 are charged to the same polarity, for example, by supplying a voltage to the conductive bearings 123 from the power source 124. Accordingly, the particles (for example, the toner or external additives) on the surface of the image holding member can be suppressed from being accumulated on the surfaces of the cleaning member 122 and the charging member 121 and can transit to the image holding member, and the particles are recovered by a cleaning device of the image holding member. Therefore, it is possible to suppress contamination particles from being accumulated on the charging member 121 and the cleaning member 122 over a long term of time, thereby maintaining the charging performance.

Image Forming Apparatus and Process Cartridge

An image forming apparatus according to this exemplary embodiment includes an image holding member, a charging unit that charges the image holding member, a latent image forming unit that forms a latent image on the charged surface of the image holding member, a developing unit that develops the latent image formed on the surface of the image holding member with toner to form a toner image, and a transfer unit that transfers the toner image formed on the surface of the image holding member to a recording medium. The charging device according to this exemplary embodiment is used as the charging unit (charging device).

On the other hand, a process cartridge according to this exemplary embodiment is attached to and detached from the image forming apparatus having, for example, the above-mentioned configuration and includes an image holding member and a charging unit that charges the image holding member. The charging device according to this exemplary embodiment is used as the charging unit. The process cartridge according to this exemplary embodiment may include at least one selected from the group having a developing unit that develops a latent image formed on the surface of an image holding member with toner to form a toner image, a transfer unit that transfers the toner image formed on the surface of the image holding member to a recording medium, and a cleaning unit that removes the toner remaining on the surface of the image holding member after transfer as needed.

Figure 5:
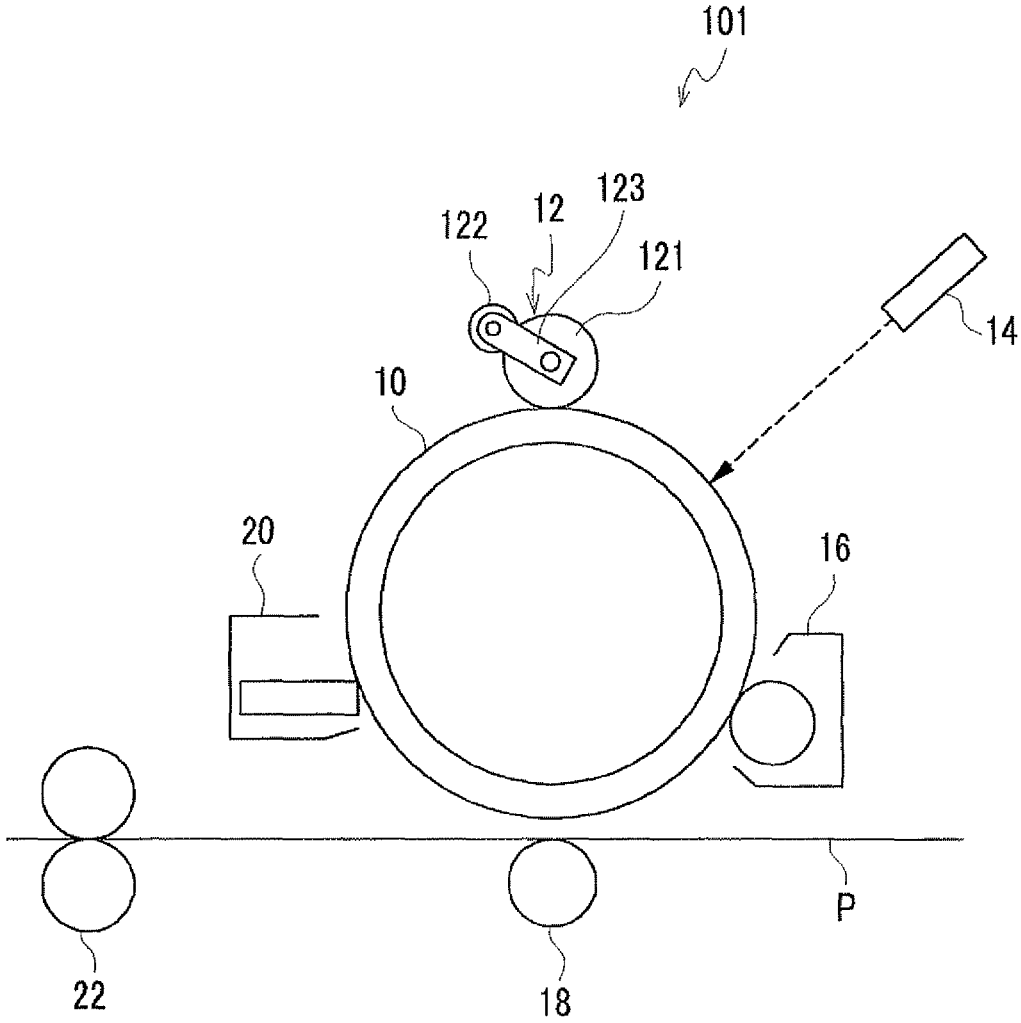
FIG. 5 is a diagram schematically illustrating the configuration of an image forming apparatus according to the exemplary embodiment.
Figure 6:
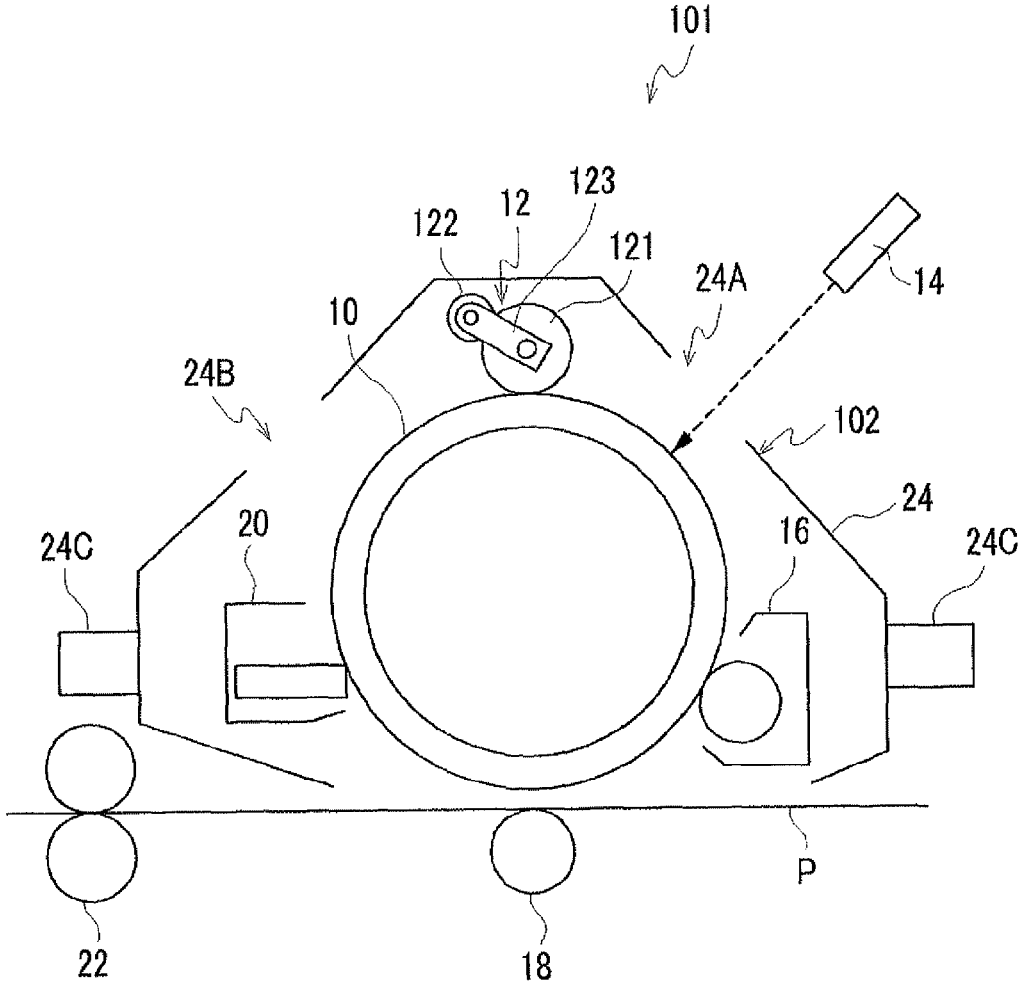
FIG. 6 is a diagram schematically illustrating the configuration of a process cartridge according to the exemplary embodiment.

The image forming apparatus and the process cartridge according to this exemplary embodiment will be described below with reference to the accompanying drawings. FIG. 5 is a diagram schematically illustrating the configuration of the image forming apparatus according to this exemplary embodiment. FIG. 6 is a diagram schematically illustrating the configuration of the process cartridge according to these exemplary embodiments.

As shown in FIG. 5, the image forming apparatus 101 according to this exemplary embodiment includes an image holding member 10 and further includes a charging device 12 charging the image holding member 10, an exposing device 14 exposing the image holding member 10 charged by the charging device 12 to form a latent image, a developing device 16 developing the latent image formed by the exposing device 14 with toner to form a toner image, a transfer device 18 transferring the toner image formed by the developing device 16 to a recording medium A, and a cleaning device 20 removing the toner remaining on the surface of the image holding member 10 after transfer, around the image holding member. The image forming apparatus 101 further includes a fixing device 22 fixing the toner image transferred to the recording medium A by the transfer device 18.

The image forming apparatus 101 according to this exemplary embodiment employs as the charging device 12 the charging device according to this exemplary embodiment provided with the charging member 121, the cleaning member 122 disposed in contact with the charging member 121, the conductive bearings 123 (conductive bearings) holding both ends in the axis direction of the charging member 121 and the cleaning member 122 so as to be independently rotatable, and the power source 124 connected to one of the conductive bearings 123.

On the other hand, the image forming apparatus 101 according to this exemplary embodiment employs the known elements of the electrophotographic image forming apparatus according to the related art as the elements other than the charging device 12 (the charging member 121). An example of each configuration will be described below.

The image holding member 10 employs a known photoreceptor without any particular limitation, and a so-called functional separation type organic photoreceptor in which a charge generating layer and a charge transporting layer are divided may be suitably used. The surface layer of the image holding member 10 may be coated with a protective layer having a charge transporting function and a cross-linking structure. In the photoreceptor, examples of the cross-linking component of the protective layer include a siloxane-based resin, a phenol-based resin, a melamine resin, a guanamine resin, and an acrylic resin.

For example, a laser optical system or an LED array is used as the exposing device 14.

The developing device 16 is a developing device that allows a developer holding member having a developer layer formed on the surface thereof to come in contact with or to get close to the image holding member 10 and attaching the toner to the latent image on the surface of the image holding member 10 to form a toner image. The developing method of the developing device 16 suitably employs a known developing method using a two-component developer. Examples of the developing method using the two-component developer include a cascade method and a magnetic brush method.

The transfer device 18 may employ any of a non-contact-type transfer method such as a corotron and a contact-type transfer method of bringing a conductive transfer roll into contact with the image holding member 10 with a recording medium A interposed therebetween and transferring the toner image to the recording medium A.

The cleaning device 20 is a member bringing, for example, a cleaning blade into direct contact with the surface of the image holding member 10 to remove the toner, the paper powder, and the dust attached to the surface. In the cleaning device 20, a cleaning brush, a cleaning roll, or the like may be used instead of the cleaning blade.

A heating fixing device using a heating roll is suitably used as the fixing device 22. The heating fixing device includes a fixing roller having a heater lamp inside a cylindrical core and a so-called release layer formed on the outer peripheral surface thereof out of a heat-resistant resin coating layer or a heat-resistant rubber coating layer and a pressing roller or a pressing belt disposed in contact with the fixing roller with a specific contact pressure and having a heat-resistant elastic layer on the outer peripheral surface of a cylindrical core or the surface of a belt-like substrate. A process of fixing a non-fixed toner image is performed by causing the recording medium A having a non-fixed toner image formed thereon to pass between the fixing roller and the pressing roller or the pressing belt and fixing the toner image by thermally melting a binder resin, additives, and the like in the toner.

The image forming apparatus 101 according to this exemplary embodiment is not limited to the above-mentioned configuration and may be an intermediate transfer type image forming apparatus employing an intermediate transfer member or a so-called tandem type image forming apparatus in which image forming units forming toner images of different colors are arranged in parallel.

On the other hand, as shown in FIG. 6, the process cartridge according to this exemplary embodiment is a process cartridge 102 in which the image holding member 10, the charging device 12 charging the image holding member, the developing device 16 developing the latent image formed by the exposing device 14 with toner to form a toner image, and the cleaning device 20 removing the toner remaining on the surface of the image holding member 10 after transfer are integrally combined, held, and constructed by the use of a case member 24 including an opening 24A for exposure, an opening 24B for erasing the charge, and an attachment rail 24C in the image forming apparatus shown in FIG. 5. The process cartridge 102 is detachably attached to the image forming apparatus 101 shown in FIG. 5.

EXAMPLES

The invention will be described in more detail below with reference to examples, but the invention is not limited to the examples. Unless otherwise mentioned, "part" means "part by weight".

Production of Photoreceptor 1

First, a cylindrical aluminum substrate with an outer diameter of 84 mmϕ having been subjected to a honing process is prepared.

Then, 100 parts by weight of a zirconium compound (product name: Orgatix ZC540, made by Matsumoto Fine Chemical Co., Ltd.), 10 parts by weight of a silane compound (product name: A1100, made by Nippon Unicar Co., Ltd.), 400 parts by weight of isopropanol, and 200 parts by weight of butanol are mixed to acquire an application solution for forming an undercoat layer.

This application solution is applied to the aluminum substrate by dipping and the resultant is heated and dried at 150° C. for 10 minutes, whereby the undercoat layer with a thickness of 0.1 μm is formed.

1 part by weight of hydroxyl gallium phthalocyanine having a strong diffraction peak at Bragg angles (2θ±0.2° of 7.5°, 9.9°, 12.5°, 16.3°, 18.6°, 25.1°, and 28.3° in a CuKα characteristic X-ray diffraction spectrum, 1 part by weight of polyvinyl butyral (S-LEC BM-S made by Sekisui Chemical Co., Ltd.), and 100 parts by weight of n-butyl acetate are mixed and are dispersed along with glass beads by the use of a paint shaker for 1 hour, whereby an application solution for forming a charge generating layer is obtained.

This application solution is applied to the undercoat layer by dipping and the resultant is heated and dried at 100° C. for 10 minutes, whereby the charge generating layer with a thickness of about 0.15 μm is formed.

2 parts by weight of a charge transporting material expressed by Formula (V-3), 3 parts by weight of a polymer compound (with a viscosity-average molecular weight of 50,000) having a structural unit expressed by Formula (V-4), and 20 parts by weight of chlorobenzene are mixed to obtain an application solution for forming a charge transporting layer.

(V-3)

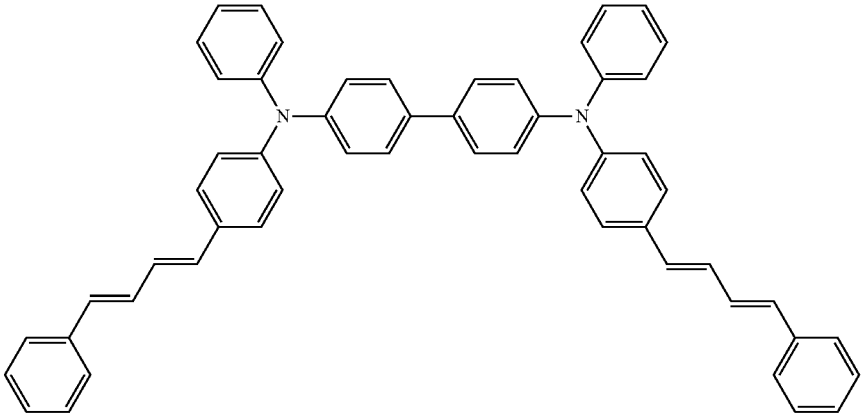

-continued (V-4)

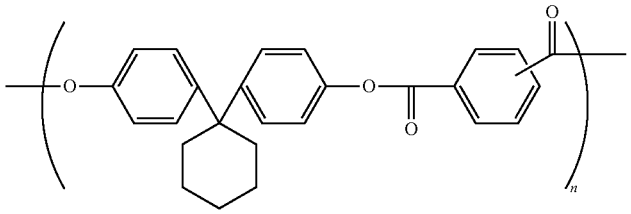

The obtained application solution for forming a charge transporting layer is applied to the charge generating layer by the use of a dipping coating method and the resultant is heated at 110° C. for 40 minutes, whereby the charge transporting layer with a thickness of 20 μm is formed. In this way, the photoreceptor having the undercoat layer, the charge generating layer, and the charge transporting layer formed on the aluminum substrate having been subjected to the honing process is used as "Photoreceptor 1".

Production of Photoreceptor 2

7 parts by weight of a resol-type phenol resin (PL-2211, made by Gunei Chemical Industry Co., Ltd.) and 0.03 part by weight of methylphenyl polysiloxane are prepared. This is dissolved in 15 parts by weight of isopropanol and 5 parts by weight of methylethyl ketone to obtain an application solution for forming a protective layer.

This application solution is applied to Photoreceptor 1 by the dipping coating method and the resultant is dried at 130° C. for 40 minutes, whereby the protective layer with a thickness of 3 μm is formed. The obtained photoreceptor is used as "Photoreceptor 2".

Production of Cleaning Member

Polyurethane EP70 made by Inoac Corporation is cut in a size of 20 mm×20 mm×250 mm which is used as Cleaning Pad a for a charging member.

A core with an outer diameter of 5 mmϕ and a length of 230 mm formed of SUS303 is inserted into Cleaning Pad a, the core is adhered to Cleaning Pad a formed of the urethane foam with a hotmelt adhesive and Cleaning Pad a is cut off to the positions apart by 5 mm from both ends of the core, whereby an elastic roll material is obtained. The resultant is ground to obtain Cleaning Roll a for a charging member with an outer diameter of 9 mmϕ.

Cleaning Roll b for a charging member is obtained in the same manner, except that the urethane foam used is replaced with polyurethane RSC made by Inoac Corporation.

Production of Aggregate 1

Aggregate 1 is synthesized with reference to JP-A-2008-273853 and Journal of the Adhesion Society of Japan, Vol. 39, p. 157 (2003).

Specifically, 25% (vol %) carbonate gas is introduced into 1600 mL, of 6% (wt %) lime milk at a milk temperature of 15° C. at 2400 mL/min while stirring, the introduction of the carbonate gas is stopped when basic calcium carbonate is generated (at a carbonation ratio of 66.6%), 800 mL of new 6% lime milk at a milk temperature of 15° C. is added to the resultant milk 800 mL, the introduction of 25% carbonate gas is restarted at 1200 mL/min, and the introduction of the carbonate gas is stopped when basic calcium carbonate is generated (at a carbonation ratio of 66.6%). This method (Production Method 1) is repeated five times, and the milk temperature is maintained at 50° C. (Temperature 1) and the carbonate gas is introduced under the same condition to finish the carbonation at the sixth time.

After the carbonation reaction is finished, the obtained product is observed by the use of a SEM. As a result, plural acicular particles (acicular crystals) protrude in a radial pattern from the center to the outside and are aggregated (see FIG. 3).

The crystal structure of the obtained product is measured by X-ray diffraction. As a result, the content of aragonite is 85%.

The obtained product is measured by the use of a laser particle size distribution measuring instrument (Zetasizer Nano ZS made by Sysmex Corporation). As a result, the average particle diameter (median size) is 11.9 μm.

The obtained product is measured by the use of a flow particle image analyzer FPIA-3000 made by Sysmex Corporation. As a result, the average circularity is 0.95.

The acicular particles of the obtained product have a length of 5 μm and an outer diameter of 1 μm.

The obtained product is used as Aggregate 1.

Production of Aggregate 2

Aggregate 2 is obtained in the same manner as for Aggregate 1, except that the number of times of repeating Production Method 1 is changed to 10 times.

In Aggregate 2, the average particle diameter is 19.8 μm and the average circularity is 0.93.

The acicular particles of Aggregate 2 have a length of 8 μm and an outer diameter of 1.2 μm.

Production of Aggregate 3

Aggregate 3 is obtained in the same manner as for Aggregate 1, except that the number of times of repeating Production Method 1 is changed to 3 times.

In Aggregate 3, the average particle diameter is 3.2 μm and the average circularity is 0.93.

The acicular particles of Aggregate 3 have a length of 1.2 μm and an outer diameter of 0.3 μm.

Production of Aggregate 4

Aggregate 4 is obtained in the same manner as for Aggregate 1, except that the number of times of repeating Production Method 1 is changed to 7 times.

In Aggregate 4, the average particle diameter is 13.9 μm and the average circularity is 0.98.

The acicular particles of Aggregate 4 have a length of 5.8 μm and an outer diameter of 1.2 μm.

Production of Aggregate 5

Aggregate 5 is obtained in the same manner as for Aggregate 1, except that Temperature 1 is changed to 60° C.

In Aggregate 5, the average particle diameter is 11.0 μm and the average circularity is 0.81.

The acicular particles of Aggregate 5 have a length of 5.1 μm and an outer diameter of 0.9 μm.

Production of Aggregate 6

Aggregate 6 is obtained in the same manner as for Aggregate 1, except that Temperature 1 is changed to 70° C.

In Aggregate 6, the average particle diameter is 11.6 μm and the average circularity is 0.75.

The acicular particles of Aggregate 6 have a length of 5.3 μm and an outer diameter of 1.1 μm.

Production of Aggregate 7

Aggregate 7 is produced with reference to JP-A-2008-254991.

Specifically, 0.3 mol of zinc sulfate and 0.17 mol of sodium chloride are dissolved in 150 cc of pure water. 500 cc of pure water is introduced into a 2 L four-necked flask, the zinc sulfate solution is added thereto, the resultant is stirred at 200 rpm by the use of a two-blade mixer with a blade diameter of 12 cm, 350 cc of an aqueous solution including 0.7 mol of ethylenediamine is added at the room temperature, the pH of the aqueous solution is adjusted to 9.4, and the resultant is left for 30 minutes to precipitate deposits. Thereafter, the temperature is raised to 100° C. and the resultant is aged for 1 hour and is then cooled, filtrated, washed with water, and dried, whereby a zinc oxide powder (Aggregate 7) is obtained.

As the result of X-ray diffraction test, it is confirmed that the resultant is zinc oxide having a good crystallization property.

As the result of observation of an electron micrograph, in the zinc oxide powder (Aggregate 7), zinc oxide particles having an acicular shape with an average short-axis diameter of 1.0 μm and an average long-axis diameter of 6.4 μm are aggregated to protrude in a radial pattern from the center to the outside. The average particle diameter is 11.2 μm and the average circularity is 0.88.

Production of Aggregate 8

Aggregate 8 is obtained in the same manner as for Aggregate 1, except that the number of times of repeating Production Method 1 is changed to 2 times.

In Aggregate 8, the average particle diameter is 2.8 μm and the average circularity is 0.91.

The acicular particles of Aggregate 8 have a length of 1.4 μm and an outer diameter of 0.4 μm.

Production of Aggregate 9

Aggregate 9 is obtained in the same manner as for Aggregate 1, except that the number of times of repeating Production Method 1 is changed to 10 times.

In Aggregate 9, the average particle diameter is 21.0 μm and the average circularity is 0.96.

The acicular particles of Aggregate 9 have a length of 10.9 μm and an outer diameter of 2.0 μm.

Production of Charging Base Roll

—Formation of Conductive Elastic Layer—

A mixture having the compositions shown in Table 1 is kneaded with an open roll, a roll with a diameter of 15 mm is formed on a conductive core surface with a diameter of 8 mm formed of SUS 303 with an adhesive layer interposed therebetween by the use of a press molding machine, and the resultant is ground to obtain Charging Base rolls A and B with a diameter of 14 mm. The unit of the following mixture contents is "part by weight".

TABLE 1

| Composition of charging base roll<br>Kind of material | | A<br>Content | B<br>Content |
|---|---|---|---|
| Elastic material | Epichlorohydrin rubber | 95.6 | 75 |
| | Nitrilebutadiene rubber | 4.4 | 25 |
| Conductive agent | Benzyl chloride triethyl ammonium | 0.9 | 0.9 |
| | Carbon black | 15 | 10 |
| Vulcanizing agent | Sulfur | 0.5 | 0.5 |
| Vulcanization accelerator | Tetramethyl lithium disulfide | 1.5 | 1.5 |
| | Dibenzothiazol disulfide | 1.5 | 1.5 |

TABLE 1-continued

| Composition of charging base roll<br>Kind of material | | A<br>Content | B<br>Content |
|---|---|---|---|
| Filler | Calcium carbonate | 20 | 20 |
| Vulcanization accelerator | Stearic acid | 1 | 1 |
| | Zinc oxide | 5 | 5 |

Example 1

A dispersion obtained by diluting a mixture having the compositions (in which the unit of compositions in the table is part by weight) shown in Table 2 with methanol and dispersing the resultant with a bead mill is applied to the surface of Charging Base roll A by dipping, the resultant is dried by heating at 180° C. for 30 minutes to form a conductive outermost layer with a thickness of 10 μm, whereby Charging Roll 1 according to Example 1 is obtained.

A charging device made to be a unit by combining Charging Roll 1 and Cleaning Member a is mounted on an image forming apparatus equipped with Photoreceptor 1 to obtain an image forming apparatus.

Examples 2 to 17 and Comparative Examples 1 to 3

Charging rolls according to the examples are obtained in the same way as Charging Roll 1 according to Example 1, except that conductive outermost layers are formed on the surfaces of charging base rolls corresponding to Tables 2 to 5 using mixtures having the compositions (in which the unit of compositions in the tables is part by weight) shown in Tables 2 to 5.

Charging rolls and cleaning members, and photoreceptors corresponding to Tables 2 to 5 are combined to obtain image forming apparatuses.

EVALUATION

Evaluation of Charging Member

Surface roughness, charging characteristic, durability, and image quality of the charging rolls according to the examples and the comparative examples are evaluated. The evaluation results are shown in Tables 2 to 5.

—Surface Roughness—

The ten-point average surface roughness Rz of the surfaces of the charging rolls (the surface of the conductive outermost layer) is measured on the basis of the JIS B0601 (1994). Specifically, under the conditions of 23° C. and 55 RH %, the surface roughness is measured by the use of a contact-type surface roughness measuring instrument (SURFCOM 570A, made by Tokyo Seimitsu Co., Ltd.). At the time of measuring the surface roughness, the measuring distance is set to 2.5 mm, a stylus of which the tip is formed of diamond (5 μmR, 90° cone) is used as a contact stylus, and the average value of the results repeatedly measured three times at different positions is calculated as the ten-point average surface roughness Rz.

—Charging Characteristic—

The charging roll is mounted on DocuCentre III C3300 (made by Fuji Xerox Co., Ltd.) instead of the charging roll included therein, and a 50% halftone image is printed on a sheet of A4 ($C^2$ paper made by Fuji Xerox Co., Ltd.) under the conditions of 10° C. and 15 RH %. An AC current value at which an image defect disappears is read out when the AC current value applied to the charging device is gradually changed (increased) from 1.0 mA.

A: The image defect disappears when the AC current value is equal to or less than 1.35 mA.

B: The image defect disappears when the AC current value is greater than 1.35 mA and equal to or less than 1.4 mA.

C: The image defect disappears when the AC current value is greater than 1.4 mA and equal to or less than 1.5 mA.

D: The image defect disappears when the AC current value is greater than 1.5 mA.

—Evaluation of Durability and Image Quality—

The charging roll is mounted on a drum cartridge of DocuCentre Color 400CP (made by Fuji Xerox Co., Ltd.), a print test with 50,000 sheets of A4 are carried out (50,000 sheets under the conditions of 10° C. and 15 RH %), then a 50% halftone image is printed by the use of the DocuCentre Color 400CP, and the obtained image is observed with eyes and is evaluated on the basis of the following criteria.

A: There is no image error.

B: A extremely slight image error is present but no problem is caused.

C: A slight image error is present but no problem is caused.

D: An image error is present.

E: An image error is present in most regions.

TABLE 2

| | | | Ex. 1 | Ex. 2 | Ex. 3 | Ex. 4 | Ex. 5 | Ex. 6 | Ex. 7 |
|---|---|---|---|---|---|---|---|---|---|
| Photoreceptor | | | 1 | 1 | 1 | 1 | 2 | 1 | 1 |
| Cleaning member | | | a | a | a | a | a | a | b |
| Shape of cleaning member | | | roll | roll | roll | roll | roll | roll | roll |
| Charging roll | | | 1 | 2 | 3 | 4 | 5 | 6 | 7 |
| Charging base roll | | | A | A | A | A | A | B | A |
| Composition of conductive outermost layer of charging roll | Resin | N-methoxy-methylated nylon | 100 | 100 | 100 | 100 | 100 | 100 | 100 |
| | | Acrylic resin compound | | | | | | | |
| | | Polyamide resin | | | | | | | |
| | Conductive agent | Carbon black | 17 | 17 | 17 | 17 | 17 | 17 | 17 |
| | Aggregate | Aggregate 1 (11.9/0.95) | 30 | | | | 30 | 30 | 30 |
| | | Aggregate 2 (19.8/0.93) | | 30 | | | | | |
| | | Aggregate 3 (3.2/0.93) | | | 30 | | | | |
| | | Aggregate 4 (13.9/0.98) | | | | 30 | | | |
| | | Aggregate 5 (11.0/0.01) | | | | | | | |
| | | Aggregate 6 (11.6/0.75) | | | | | | | |
| | | Aggregate 7 (11.2/0.88) | | | | | | | |
| | | Aggregate 8 (2.8/0.91) | | | | | | | |
| | | Aggregate 9 (21.0/0.96) | | | | | | | |
| | Catalyst | Nacure 4167 | 4.4 | 4.4 | 4.4 | 4.4 | 4.4 | 4.4 | 4.4 |
| Evaluation | Surface roughness (μm) | | 9.6 | 12.6 | 9.2 | 13.1 | 9.1 | 9.7 | 10.1 |
| | Charging Characteristic | | A | A | A | A | A | A | A |
| | Durability and image quality | | A | A | A | A | A | A | A |

* Regarding numerical values of aggregates in brackets, the left side represents the average particle diameter (μm) and the right side represents the average circularity.

TABLE 3

| | | | Ex. 8 | Ex. 9 | Ex. 10 | Ex. 11 | Ex. 12 | Ex. 13 | Ex. 14 |
|---|---|---|---|---|---|---|---|---|---|
| Photoreceptor | | | 1 | 1 | 1 | 1 | 1 | 1 | 2 |
| Cleaning member | | | a | a | a | a | a | a | a |
| Shape of cleaning member | | | Pad | Roll | Roll | Roll | Roll | Roll | Roll |
| Charging roll | | | 8 | 9 | 10 | 11 | 12 | 13 | 14 |
| Charging base roll | | | A | A | A | A | A | A | A |
| Composition of conductive outermost layer of charging roll | Resin | N-methoxy-methylated nylon | 100 | 100 | 100 | 100 | 100 | | 100 |
| | | Acrylic resin compound | | | | | | 100 | |
| | | Polyamide resin | | | | | | | 100 |
| | Conductive agent | Carbon black | 17 | 17 | 17 | 17 | 17 | 17 | 17 |
| | Aggregate | Aggregate 1 (11.9/0.95) | 30 | 5 | | | | 30 | 30 |
| | | Aggregate 2 (19.8/0.93) | | | 50 | | | | |
| | | Aggregate 3 (3.2/0.93) | | | | | | | |
| | | Aggregate 4 (13.9/0.98) | | | | | | | |
| | | Aggregate 5 (11.0/0.81) | | | | 30 | | | |
| | | Aggregate 6 (11.6/0.75) | | | | | 30 | | |
| | | Aggregate 7 (11.2/0.88) | | | | | | | |
| | | Aggregate 8 (2.8/0.91) | | | | | | | |
| | | Aggregate 9 (21.0/0.96) | | | | | | | |
| | Catalyst | Nacure 4167 | 4.4 | 4.4 | 4.4 | 4.4 | 4.4 | | |
| Evaluation | Surface roughness (μm) | | 8.8 | 2.3 | 19.8 | 9.2 | 9.1 | 9.6 | 9.6 |
| | Charging Characteristic | | A | B | A | B | B | A | A |
| | Durability and image quality | | A | A | B | A | A | A | A |

* Regarding numerical values of aggregates in brackets, the left side represents the average particle diameter (μm) and the right side represents the average circularity.

TABLE 4

| | | | Ex. 15 | Ex. 16 | Ex. 17 |
|---|---|---|---|---|---|
| Photoreceptor | | | 1 | 1 | 1 |
| Cleaning member | | | a | a | a |
| Shape of cleaning member | | | Roll | Roll | Roll |
| Charging roll | | | 15 | 16 | 17 |
| Charging base roll | | | A | A | A |
| Composition of conductive outermost layer of charging roll | Resin | N-methoxy-methylated nylon | 100 | 100 | 100 |
| | | Acrylic resin compound | | | |
| | | Polyamide resin | | | |
| | Conductive agent | Carbon black | 17 | 17 | 17 |
| | Aggregate | Aggregate 1 (11.9/0.95) | | | |
| | | Aggregate 2 (19.8/0.93) | | | |
| | | Aggregate 3 (3.2/0.93) | | | |
| | | Aggregate 4 (13.9/0.98) | | | |
| | | Aggregate 5 (11.0/0.81) | | | |
| | | Aggregate 6 (11.6/0.75) | | | |
| | | Aggregate 7 (11.2/0.88) | 30 | | |
| | | Aggregate 8 (2.8/0.91) | | 30 | |
| | | Aggregate 9 (21.0/0.96) | | | 30 |
| | Catalyst | Nacure 4167 | 4.4 | 4.4 | 4.4 |
| Evaluation | Surface roughness (μm) | | 9.6 | 1.2 | 22 |
| | Charging Characteristic | | A | C | A |
| | Durability and image quality | | A | C | C |

* Regarding numerical values of aggregates in brackets, the left side represents the average particle diameter (μm) and the right side represents the average circularity.

TABLE 5

| | | | Com. Ex. 1 | Com. Ex. 2 | Com. Ex. 3 |
|---|---|---|---|---|---|
| Photoreceptor | | | 1 | 1 | 1 |
| Cleaning member | | | a | a | a |
| Shape of cleaning member | | | Roll | Roll | Roll |
| Charging roll | | | Com. Ex. 1 | Com. Ex. 2 | Com. Ex. 3 |
| Charging base roll | | | A | A | A |
| Composition of conductive outermost layer of charging roll | Resin | N-methoxy-methylated nylon | 100 | 100 | 100 |
| | | Acrylic resin compound | | | |
| | | Polyamide resin | | | |
| | Conductive agent | Carbon black | 17 | 17 | 17 |
| | Particle | Conductive filler 1 | | 100 | |
| | | Insulating filler 1 | | | 30 |
| | Catalyst | Nacure 4167 | 4.4 | 4.4 | 4.4 |
| Evaluation | Surface roughness (μm) | | 1.8 | 21.6 | 9.6 |
| | Charging Characteristic | | C | B | C |
| | Durability and image quality | | D | D | D |

From the results, it can be seen that the examples provide more excellent charging characteristic, durability, and image quality than the comparative examples.

The details of the kinds of materials shown in Tables 1 to 4 are as follows.

—Resin—

N-methoxy-methylated nylon 1: F30K, made by Nagase ChemteX Corporation

Acrylic resin compound: Ethoxylated trimethylolpropane triacrylate (SR-454, made by Nippon Kayaku Co., Ltd.) and silane coupling agent (KBM-5103, made by Shin-Etsu Chemical Co., Ltd.) are compounded at 9:1.

Polyamide resin: AmilanCM8000, made by Toray Industries Inc.

—Conductive Agent—

Carbon black: MONAHRCH 1000, made by Cabot Corp. (with average particle diameter of 43 nm)

—Particles—

Conductive Filler 1: NICABEADS PC1020, made by Nippon Carbon Co., Ltd. (volume average particle diameter of 13 μm and average circularity of 0.93)

Insulating Filler 1: Silica particles (FB7SDC), made by Denki Kagaku Kogyo KK. (with average particle diameter of 6 μm and average circularity of 0.99)

—Catalyst—

Nacure 4167, made by King Industries Inc.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member, comprising:

a substrate; and a conductive outermost layer that is disposed on the substrate and that comes in contact with a charging object, and that includes (A) a resin and (B) aggregates of a plurality of acicular particles protruding in a radial pattern from a center to an outside, wherein a surface of the conductive outermost layer where the aggregates are present contains convex and concave portions having a large pitch formed by a particle diameter of each aggregate, and convex and concave subportions having a small pitch on a surface of the convex portions formed by tips of the acicular particles, and wherein the charging member charges the charging object by coming in contact with the charging object in a state where a voltage is applied to the charging member.

2. The charging member according to claim 1, wherein an average particle diameter of (B) the aggregates is in a range of from about 3 μm to about 20 μm.

3. The charging member according to claim 1, wherein an average particle diameter of (B) the aggregates is in a range of from about 3 μm to about 15 μm.

4. The charging member according to claim 1, wherein an average particle diameter of (B) the aggregates is in a range of from about 3 μm to about 12 μm.

5. The charging member according to claim 1, wherein an average circularity of (B) the aggregates is in a range of from about 0.8 to about 1.0.

6. The charging member according to claim 1, wherein (A) the resin is a polyamide resin.

7. The charging member according to claim 6, wherein the polyamide resin is a methoxy-methylated polyamide resin.

8. The charging member according to claim 1, wherein the acicular particles include calcium carbonate particles or zinc oxide particles.

9. The charging member according to claim 1, wherein the acicular particles include calcium carbonate particles.

10. The charging member according to claim 1, wherein a content of (B) the aggregates in the conductive outermost layer is in a range of from about 1 weight % to about 50 weight %.

11. A charging device comprising the charging member according to claim 1.

12. A process cartridge being detachable from an image forming apparatus, the process cartridge comprising:

an image holding member; and a charging device that charges the image holding member and that has the charging member according to claim 1.

13. An image forming apparatus comprising:

an image holding member;

a charging device that charges the image holding member and that has the charging member according to claim 1;

a latent image forming device that forms a latent image on a charged surface of the image holding member;

a developing device that develops the latent image formed on the surface of the image holding member to form a toner image; and a transfer device that transfers the toner image formed on the surface of the image holding member to a recording medium.

* * * * *